US006343131B1

(12) United States Patent
Huopaniemi

(10) Patent No.: US 6,343,131 B1
(45) Date of Patent: Jan. 29, 2002

(54) METHOD AND A SYSTEM FOR PROCESSING A VIRTUAL ACOUSTIC ENVIRONMENT

(75) Inventor: Jyri Huopaniemi, Helsinki (FI)

(73) Assignee: Nokia OYJ, Espoo (FI)

( * ) Notice: Subject to any disclaimer, the term of this patent is extended or adjusted under 35 U.S.C. 154(b) by 0 days.

(21) Appl. No.: 09/174,989

(22) Filed: Oct. 19, 1998

(30) Foreign Application Priority Data

Oct. 20, 1997 (FI) ..... 974006

(51) Int. Cl.[7] ..... H04R 5/02
(52) U.S. Cl. ..... 381/310; 381/63
(58) Field of Search ..... 381/1, 17, 18, 381/19, 61, 63, 310

(56) References Cited

U.S. PATENT DOCUMENTS 3,970,787 A 7/1976 Searle
4,731,848 A 3/1988 Kendall et al. ..... 381/63
5,467,401 A 11/1995 Nagamitsu et al. ..... 381/63
5,485,514 A 1/1996 Knappe et al.
5,999,630 A * 12/1999 Iwamatsu ..... 381/63

FOREIGN PATENT DOCUMENTS

EP 0 735 796 A2 10/1996

OTHER PUBLICATIONS

Kleiner et al. "Auralization—An Overview", 1993, J. Audio Eng. Soc., vol. 41, No. 11, pp. 861–875 Finnish Official Action.

* cited by examiner

*Primary Examiner*—Minsun Oh Harvey
(74) *Attorney, Agent, or Firm*—Perman & Green, LLP

(57) ABSTRACT

A virtual acoustic environment comprises surfaces which reflect, absorb and transmit sound. Parametrisized filters are used to represent the surfaces, and parameters defining the transfer function of the filters are presented in order to represent the parametrisized filters.

11 Claims, 5 Drawing Sheets

METHOD AND A SYSTEM FOR PROCESSING A VIRTUAL ACOUSTIC ENVIRONMENT

TECHNOLOGICAL FIELD

The invention relates to a method and a system which to a listener can create an artificial auditory impression corresponding to a certain space. Particularly the invention relates to the transfer of such an auditory impression in a system which in digital form transfers, processes and/or compresses information to be presented to a user.

BACKGROUND OF THE INVENTION

A virtual acoustic environment refers to an auditory impression, with the aid of which a person listening to an electrically reproduced sound can imagine himself to be in a certain space. A simple means to create a virtual acoustic environment is to add reverberation, whereby the listener gets an impression of a space. Complicated virtual acoustic environments often try to imitate a certain real space, whereby it is often called the auralisation of said space. This concept is described for instance in the article M. Kleiner, B.-I. Dalenbäck, P. Svensson: "Auralization—An Overview", 1993, J. Audio Eng. Soc., Vol. 41, No. 11, pp. 861–875. In a natural way the auralisation can be combined with the creation of a virtual visual environment, whereby a user provided with suitable display devices and speakers or earphones can observe a desired real or imagined space, and even "move" in said space, whereby his audio-visual impression is different depending on which point in said environment he selects to be his observation point.

The creation of a virtual acoustic environment is divided into three factors, which are the modelling of the sound source, the modelling of the space, and the modelling of the listener. The present invention relates particularly to the modelling of the space, whereby an aim is to create an idea about how the sound propagates, how it is reflected and attenuated in said space, and to convey this idea in an electrical form to be used by the listener. Known methods for modelling the acoustics of a space are the so called ray-tracing and the image source method. In the former method the sound generated by the sound source is divided into a three-dimensional bundle comprising "sound rays" propagating in a substantially rectilinear manner, and then a calculation is made about how each ray propagates in the space being processed. The auditory impression obtained by the listener is generated by adding the sound represented by those rays which, during a certain period and via a certain maximum number of reflections, arrive at the observation point chosen by the listener. In the image source method a plurality of virtual image sources are generated for the original sound source, whereby these virtual sources are mirror images of the sound source regarding the examined reflecting surfaces: behind each examined reflecting surface there is placed one image source having a direct distance to the observation point which equals the distance between the original sound source and the observation point as measured via the reflection. Further, the sound from the image source arrives at the observation point from the same direction as the real reflected sound. The auditory impression is obtained by adding the sounds generated by the image sources.

The prior art methods present a very heavy calculation load. If we assume that the virtual environment is transferred to the user for instance by a radio broadcasting or via a data network, then the user's receiver should continuously trace even as much as tens of thousands of sound rays or add the sound generated by thousands of image sources. Moreover, the basis of the calculation changes always when the user decides to change the position of the observation point. With present devices and prior art methods it is practically impossible to transfer the auralised sound environment.

SUMMARY OF THE INVENTION

The object of the present invention is to present a method and a system with which a virtual acoustic environment can be transferred to a user at a reasonable calculation load.

The objects of the invention are attained by dividing the environment to be modelled into sections, for which there are created parametrisized reflections and/or absorption models as well as transmission models, and by treating mainly the parameters of the model in the data transmission.

The method according to the invention is characterised in that there the surfaces are represented by parametrisized filters.

The invention also relates to a system, which is characterised in that it comprises means for forming a filter bank comprising parametrisized filters for the modelling of the surfaces.

According to the invention the acoustic characteristics of a space can be modelled in a manner, the principle of which is as such known from the visual modelling of surfaces. Here a surface means quite generally an object of the examined space, whereby the object's characteristics are relatively homogenous regarding the model created for the space. For each examined surface there are defined a plurality of coefficients (in addition to its visual characteristics, if the model contains visual characteristics) which represent the acoustic characteristics of the surface, whereby such coefficients are for instance the reflection coefficient, the absorption coefficient and the transmission coefficient. More generally we may state that a certain parametrisized transfer function is defined for the surface. In the model to be created of the space said surface is represented by a filter, which realises said transfer function. When a sound from the sound source is used as an input to the system, the response generated by the transfer function represents the sound when it has hit said surface. The acoustic model of the space is formed by a plurality of filters, of which each represents a certain surface in the space.

If the design of the filter representing the acoustic characteristics of the surface, and the parametrisized transfer function realised by the filter are known, then for the representation of a certain surface it is sufficient to give the transfer function parameters characterising said surface. In a system intended to transfer a virtual environment as a data stream there is a receiver and/or a reproducing device, into the memory of which there is stored the type or types of the filter and of the transfer function used by the system. The device gets the data stream functioning as its input data, for instance by receiving it by a radio or a television receiver, by downloading it from a data network, such as the Internet network, or by reading it locally from a recording means. At the start of the operation the device gets in the data stream those parameters which are used for modelling the surfaces within the virtual environment to be created. With the aid of these data and the stored filter types and transfer function types the device creates a filter bank which corresponds to the acoustic characteristics of the virtual environment to be created. During operation the device gets within the data stream a sound, which it must reproduce to the user, whereby it supplies the sound into the filter bank which it has created, and as a result it gets the processed sound, and the user listening to this sound perceives an impression of the desired virtual environment.

The required amount of transmitted data can be further reduced by forming a data-base comprising certain standard surfaces and being stored in the memory of the receiver/reproduction device. The database contains parameters, with which it is possible to describe the standard surfaces defined by the database. If the virtual environment to be created comprises only standard surfaces, then only the identifiers of the standard surfaces in the database have to be transmitted within the data stream, whereby the parameters of the transfer functions corresponding to these identifiers can be read from the database and it will not be necessary to transfer them separately to the receiver/reproduction device. The database can also contain information about such complex filter types and/or transfer functions, which are no similar to those filter types and transfer functions which are generally used in the system, and which would consume unreasonably much of the system's data transmission capacity if they should be transmitted with the data stream when required.

BRIEF DESCRIPTION OF THE DRAWINGS

Below the invention is described in more detail with reference to preferred embodiments presented as examples, and to the enclosed figures, in which.

The same reference numerals are used for corresponding parts.

DETAILED DESCRIPTION OF THE INVENTION

Figure 1:
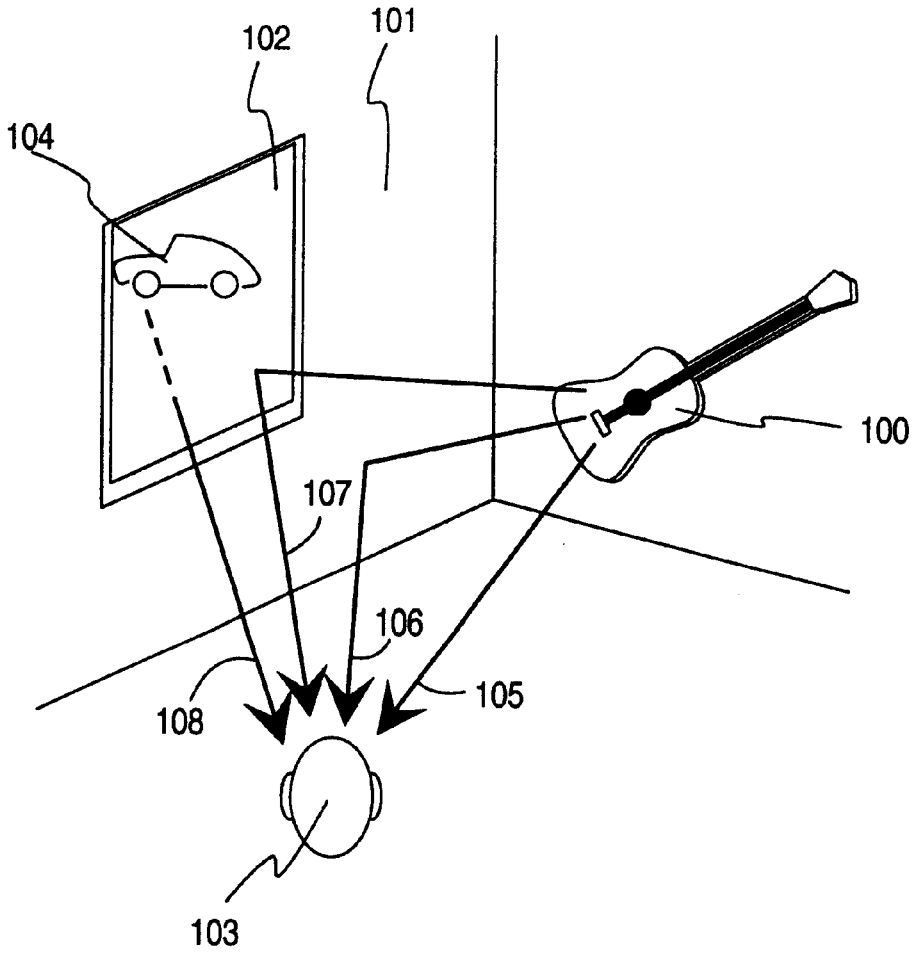
FIG. 1 shows an acoustic environment to be modelled.

FIG. 1 shows an acoustic environment containing a sound source 100, reflecting surfaces 101 and 102, and an observation point 103. Further, an interference sound source 104 belongs to the acoustic environment. Sounds propagating from the sound sources to the observation point are represented by arrows. The sound 105 propagates directly from the sound source 100 to the observation point 103. The sound 106 is reflected from the wall 101, and the sound 107 is reflected from the window 102. The sound 108 is a sound generated by the interference sound source 104 and this sound arrives at the observation point 103 through the window 102. All sounds propagate in the air which occupies the acoustic environment to be examined, except at the reflection moments and when the pass through the window glass.

Regarding the modelling of the space all sounds shown in the figure behave differently. The sound 105 propagating directly is affected by the delay caused by the distance between the sound source and the observation point and the speed of the sound in air, as well as by the attenuation caused by the air. The sound 106 reflected from the wall is affected by, in addition to the influence caused by the delay and the air attenuation, also by the attenuation of the sound and by a possible phase shift when it hits the obstacle. The same factors affect the sound 107 reflected from the window, but because the material of the wall and the window glass are acoustically different the sound is reflected and attenuated and the phase is shifted in different ways in these reflections. The sound 108 from the interference sound source passes through the window glass, whereby the possibility to detect it in the observation point is affected by the transmission characteristics of the window glass in addition to the effects of the delay and the attenuation of the air. In this example the wall can be assumed to have so good acoustic isolating characteristics that the sound generated by the interference sound source 104 does not pass through the wall to the observation point.

Figure 2:
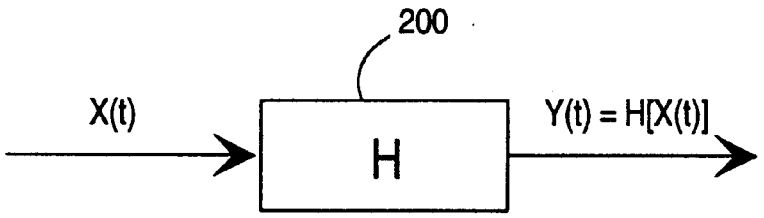
FIG. 2 shows a parametrisized filter.

FIG. 2 shows generally a filter, i.e. a device 200 with a certain transfer function H and intended for processing a time dependent signal. The time dependent impulse function X(t) is transformed in the filter 200 into a time dependent response function Y(t). If the time dependent functions are presented in a way known as such by their Z-transforms, then the Z-transform H(z) of the transfer function can be expressed as the ratio $$H(z) = \frac{Y(z)}{X(z)} = \frac{\sum_{k=0}^{M} b_k z^{-k}}{1 + \sum_{k=1}^{N} a_k z^{-k}} \tag{1}$$

whereby, in order to transmit an arbitrary transfer function in the parameter form, it is sufficient to transmit the coefficients $[b_0\ b_1\ a_1\ b_2\ a_2\ \ldots]$ used in the expression of its Z-transform.

In a system utilising digital signal processing the filter 200 can be for instance an IIR filter (Infinite Impulse Response) filter known as such, or a FIR filter (Finite Impulse Response). Regarding the invention it is essential that the filter 200 can be defined as a parametrisized filter. A simpler alternative than the above presented definition of the transfer function is to define that in the filter 200 the impulse signal is multiplied by a set of coefficients representing the characteristics of a desired surface, whereby filter parameters are for instance the signal's reflection and/or absorption coefficient, the signal's attenuation coefficient for a signal passing through, the signal's delay, and the signal's phase shift. A parametrisized filter can realise a transfer function, which always is of the same type, but the relative shares of the different parts of the transfer function appear differently in the response, depending on which parameters were given to the filter. If the purpose of a filter 200, which is defined only with coefficients, is to represent a surface reflecting the sound particularly well, and if the impulse X(t) is a certain sound signal, then the filter is given as parameters a reflection coefficient close to one, and an absorption coefficient close to zero. The parameters of the filter's transfer function can be frequency dependent, because high sounds and low sounds are often reflected and absorbed in different ways.

Figure 3A:
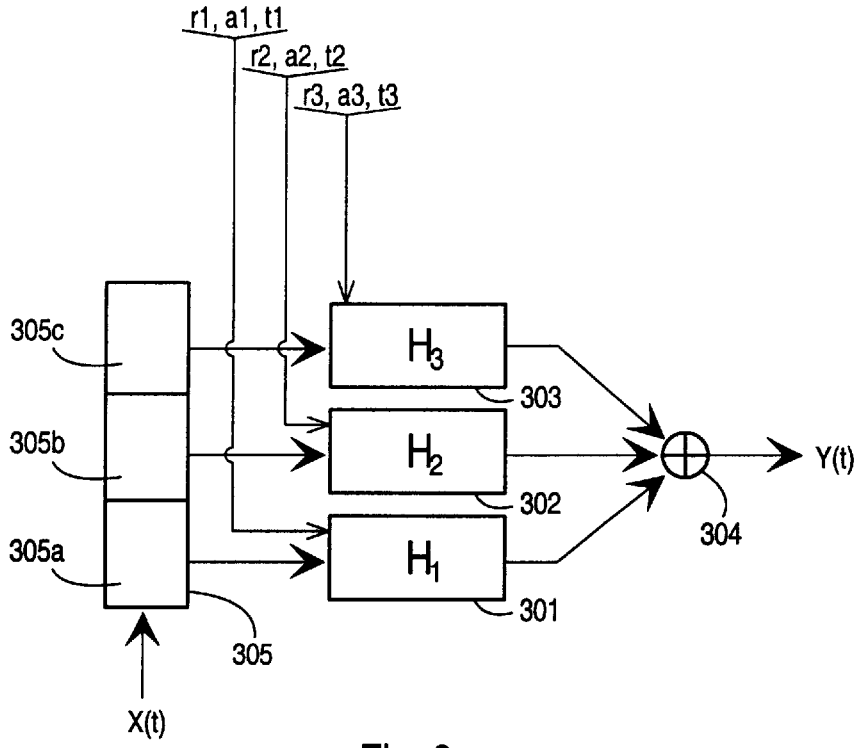
FIG. 3*a* shows a filter bank formed by parametrisized filters.

According to a preferred embodiment of the invention the surfaces of a space to be modelled are divided into nodes, and of all essential nodes there is formed an own filter model where the filter's transfer function represents the reflected, the absorbed and the transmitted sound in different ratios, depending on the parameters given to the filter. The space to be modelled shown in FIG. 1 can be represented by a simple model where there are only a few nodes. FIG. 3*a* shows a filter bank comprising three filters where each filter represents a surface of the space to be modelled. The transfer function of the first filter 301 can represent a reflection which is not separately shown in FIG. 2, the transfer function of the second filter 302 can represent a reflection of the sound from the wall, and the transfer function of the third filter 303 can represent both the reflection of the sound from the window glass and the passage of the sound through the window glass. When a sound from the sound source 100 acts as the impulse function X(t), then the parameters r (reflection coefficient), a (absorption coefficient) and t (transmission coefficient) of the filters 301, 302 and 303 are set so that the response provided by the filter 301 represents a sound reflected by a surface not shown in FIG. 2, the response provided by the filter 302 represents a sound reflected from the wall, and the response of the filter 303 represents a sound reflected from the window glass. If, for instance, we assume that the wall is of a highly absorbing material and the window glass of a highly reflecting material, then in the embodiment of the figure the reflection coefficient r2 is close to zero, and the reflection coefficient r3 of the window glass is correspondingly close to one. Generally it can be noted that the absorption coefficient and the reflection coefficient of a certain surface depend on each other: the lower the absorption the higher the reflection and vice versa (mathematically the dependence is of the form $r=\sqrt{1-a}$). The responses given by the filters are added in the adder 304.

When the interference sound 108 shown in FIG. 1 is desired to be modelled with the filter bank of FIG. 3*a* the absorption coefficients a1 and a2 of the filters 301 and 302 are set to ones, whereby there is not formed any reflected component of the interference sound. In the filter 303 the transmission coefficient t3 is set to a value, with which the filter 303 can be made to represent the sound which was transmitted through the window glass.

Figure 3B:
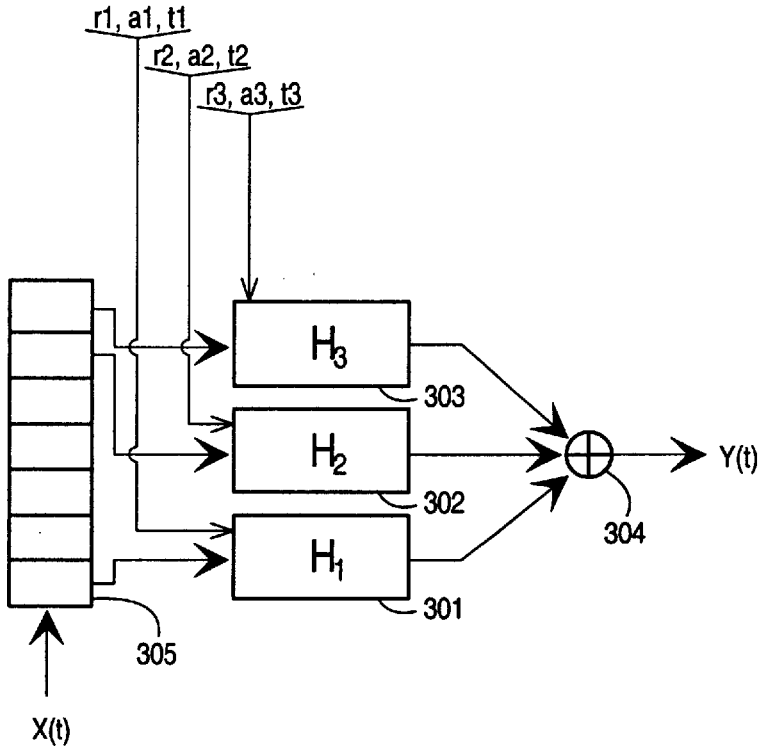
FIG. 3*b* shows a modification of the arrangement in FIG. 3*a;*

The FIG. 3*a* also shows a delay element 305 which generates the mutual time differences of sound components propagating along different paths to the observation point. The sound which propagated directly will reach the observation point in the shortest time, which is represented by it being delayed only in the first stage 305*a* of the delay element. The sound reflected via the wall is delayed in the two first stages 305*a* and 305*b* of the delay element, and the sound reflected via the window is delayed in all stages 305*a*, 305*b* and 305*c* of the delay element. Because in FIG. 1 the distance covered by the sound is almost the same via the wall as via the window it may be deduced that the different stages in the delay means 305 represent delays of different sizes: the third stage 305*c* can not delay the sound very much more. As an alternative embodiment we can conceive the solution according to the FIG. 3*b* where all stages of the delay means are of equal size, but where the output from the delay elements to the filters can be made at different points depending on the desired respective delay.

Figure 4:
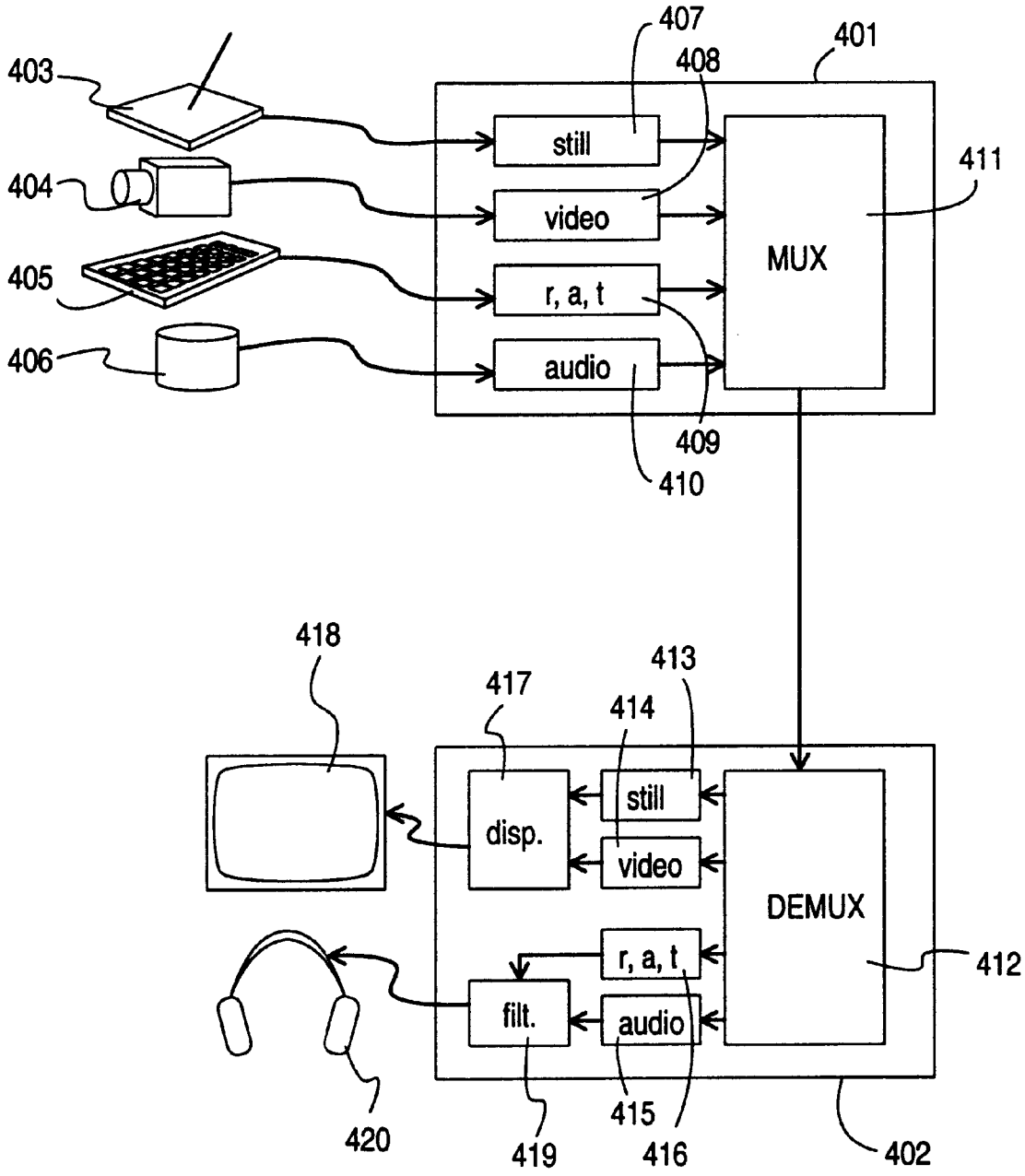
FIG. 4 shows a system for applying the invention.

FIG. 4 shows a system having a transmitting device 401 and a receiving device 402. The transmitting device 401 forms a certain virtual acoustic environment containing at least one sound source and the acoustic characteristics of at least one space, and it conveys it in some form to the receiving device 402. The conveyance can be made for instance in a digital form as a radio or television broadcast or via a data network. The conveyance can also mean that on the basis of the virtual acoustic environment generated by the transmitting device 401 it produces a recording, such as a DVD disk (Digital Versatile Disk), which the user of the receiving device procures. A typical application conveyed as a recording could be a concert where the sound source is an orchestra comprising virtual instruments and the space is an imaginary or real concert hall which is electrically modelled, whereby the user of the receiving device can listen with his equipment how the performance sounds at different points of the hall. If such a virtual environment audio-visual, then it also contains a visual section realised by computer graphics. The invention does not require that the transmitting and receiving devices are separate devices, but the user can create a certain virtual acoustic environment in one device and use the same device to examine his creation.

In the embodiment shown in FIG. 4 the user of the transmitting device creates a certain visual environment such as a concert hall with computer graphics tools 403, and a video animation such as the musicians and the instruments of a virtual orchestra with corresponding tools 404. Further he enters by a keyboard 405 certain acoustic characteristics for the surfaces of the environment that he created, such as the reflection coefficients r, the absorption coefficients a and the transmission coefficients t, or more generally the transfer functions representing the surfaces. The sounds of the virtual instruments are loaded from the database 406. The transmitting device processes the information given by the user into bit streams in the blocks 407, 408, 409 and 410, and combines the bit streams into one data stream in the multiplexer 411. The data stream is conveyed in some form to the receiving device 402 where the demultiplexer 412 from the data stream extracts and supplies the video part representing the environment into the block 413, the time dependent video part or the animation into the block 414, the time dependent sound into the block 415, and the coefficients representing the surfaces into the block 416. The video parts are combined in the display driver block 417 and supplied to the display 418. The signal representing the sound transmitted by the sound source is directed from the block 415 to the filter bank 419, where the filters have been given the parameters which were obtained from the block 416 and which represent the characteristics of the surfaces. The filter bank 419 provides a sound which comprises different reflections and attenuations and which is directed to the earphones 420.

Figure 5B:
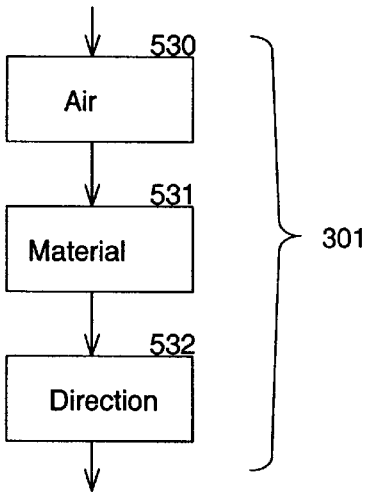
FIG. 5*b* shows a part of FIG. 5*a* in more detail.
Figure 5A:
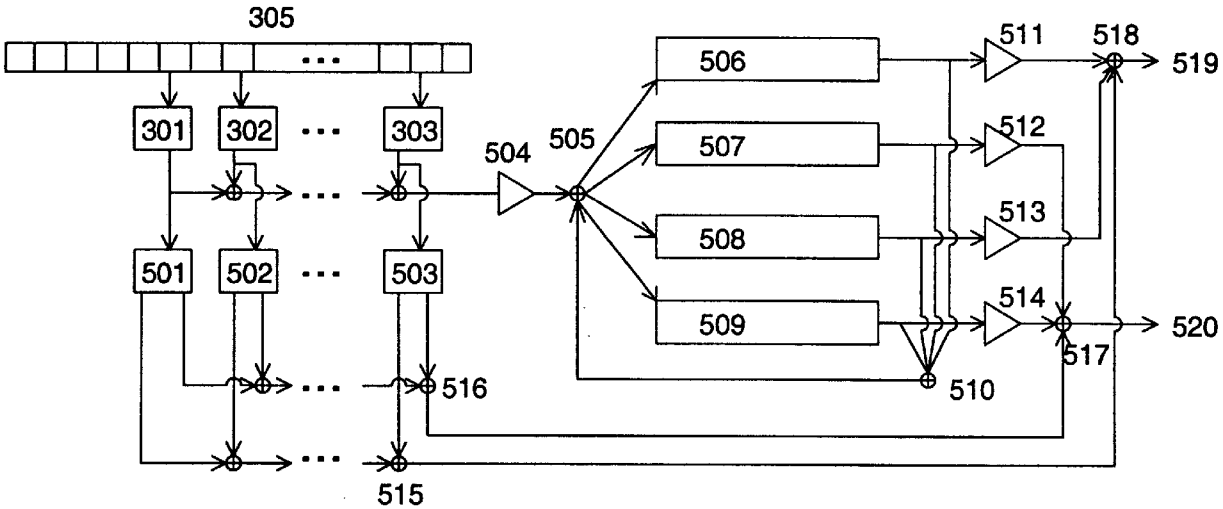
FIG. 5*a* shows a part of FIG. 4 in more detail.

The FIGS. 5*a* and 5*b* show in more detail a receiving device's filter arrangement which can realise a virtual acoustic environment in a manner according to the invention. The delay means 305 corresponds to the delay means shown in the FIGS. 3*a* and 3*b*, and it generates the mutual time differences of the different sound components (for instance the sounds reflected along different paths). The filters 301, 302 and 303 are parametrisized filters which are given certain parameters in a manner according to the invention, whereby each of the filters 301, 302 and 303 and of other corresponding filters shown in the figure only by dots, provides a model of a certain surface of the virtual environment. The signal provided by said filters is branched, on one hand to the filters 501, 502 and 503, and on the other hand via adders and the amplifier 504 to the adder 505, which together with the echo branches 506, 507, 508 and 509 and the adder 510 as well as with the amplifiers 511, 512, 513 and 514 form a circuit known per se, with which it is possible to generate reverberation in a certain signal. The filters 501, 502 and 503 are direction filters known per se, which take into account differences of the listeners auditory perceptions in different direction, for instance according to the HRTF model (Head-Related Transfer Function). Most preferably the filters 501, 502 and 503 contain also so called ITD delays (Interaural Time Difference), which represent the mutual time differences of sound components arriving from different directions.

In the filters 501, 502 and 503 each signal component is divided into a left and a right channel, or in multi-channel system more generally into N channels. All signals belonging to a certain channel are assembled in the adder 515 or 516 and supplied to the adder 517 or 518, where the respective reverberation is added to the signal of each channel. The lines 519 and 520 lead to the speakers or to the earphones. In FIG. 5*a* the dots between the filters 302 and 303 as well as between the filters 502 and 503 mean that the invention does not impose restrictions on how many filters there are in the filter bank of the receiver device. There may be even several hundreds or thousands of filters, depending on the complexity of the modelled virtual acoustic environment.

FIG. 5*b* shows in more detail one possibility to realise such a parametrisized filter 301 which represents a reflecting surface. In FIG. 5*b* the filter 301 comprises three successive filter stages 530, 531 and 532, of which the first stage 530 represents the propagation attenuation in a medium (generally air), the second stage 531 represents the absorption occurring in the reflecting material, and the third stage 532 takes into account the directivity of the sound source. In the first stage 530 it is possible to take into account both the distance which the sound travelled in the medium from the sound source via the reflecting surface to the observation point and the characteristics of the medium, such as the humidity, pressure and temperature of the air. In order to calculate the distance the stage 530 obtains from the transmitting device information about the position of the sound source in the co-ordinate system of the space to be modelled and from the receiving device information about the co-ordinates of that point which the user has chosen to be the observation point. The information describing the characteristics of the medium is obtained by the first stage 530 either from the transmitting device or from the receiving device (the user of the receiving device can have a possibility to set desired characteristics for the medium). As a default the second stage 531 obtains the coefficient representing the absorption of the reflecting surface from the transmitting device, although also in this case the user of the receiving device can be given the possibility to vary the characteristics of the modelled space. The third stage 532 takes into account how the sound transmitted by the sound source is directed from the sound source into different directions in the space to be modelled, and in which direction the reflecting surface modelled by the filter 301 is located.

Above we have generally discussed how the characteristics of a virtual acoustic environment can be processed and transferred from one device to another by the use of parameters. Next we discuss the application of the invention to a particular form of data transmission. "Multimedia" means a synchronised presentation of audio-visual objects to the user. Interactive multimedia presentations are thought to find wide-spread use in the future, for instance as a form of entertainment and teleconferencing. In prior art there are known a number of standards which define different ways to transfer multimedia programs in an electrical form. In this patent application we treat particularly so called MPEG standards (Motion Picture Experts Group), of which particularly the MPEG-4 standard, which is under preparation when this patent application is submitted, has as an aim that a transmitted multimedia presentation can contain real and virtual objects which together form a certain audio-visual environment. The invention is further applicable for instance in cases according to the VRML standard (Virtual Reality Modelling Language).

A data stream according to the MPEG-4 standard comprises multiplexed audio-visual objects which can contain both a part, which is continuous in time (such as a certain synthesised sound), and parameters (such as the position of a sound source in the space to be modelled). The objects can be defined as hierarchical ones, whereby the so called primitive objects are on the lower level of the hierarchy. In addition to the objects a multimedia program according to the MPEG-4 standard contains a so called scene description, which contains such information relating to the mutual relations of the objects and to the arrangement of the general composition of the program which is most preferably encoded and decoded separately from the actual objects. The scene description is also called the BIFS part (Binary Format for Scene description). The transfer of a virtual acoustic environment according to the invention is advantageously realised so that a part of the information relating to it is transferred in the BIFS part, and a part of it by using the Structured Audio Orchestra Language/Structured Audio Score Language (SAOL/SASL) defined by the MPEG-4 standard.

In a known way the BIFS part contains a defined surface description (Material node) which contains fields for the transfer of parameters visually representing the surfaces, such as SFFloat ambientIntensity, SFColor diffuseColor, SFColor emissiveColor, SFFloat shininess, SFColor specularColor and SFFloat transparency. The invention can be applied by adding to this description the following fields applicable for the transfer of acoustic parameters:

SFFloat diffuseSound

The value transferred in the field is a coefficient which determines the diffusivity of the acoustic reflection from the surface. The value of the coefficient is in the range from zero to one.

MFFloat reffuncSound

The field transfers one or more parameters which determine the transfer function modelling the acoustic reflections from the surface in question. If a simple coefficient model is used, then for the sake of clarity, instead of this field it is possible to transfer a field named differently refcoeffSound, where the transferred parameter is most preferably the same as the above mentioned reflection coefficient r, or a set of coefficients of which each represents the reflection in a certain predetermined frequency band. If a more complex transfer function is used, then we have here a set of parameters which determine the transfer function, for instance in the same way as was presented above in connection with the formula (1).

MFFloat transfuncSound

The field transfers one or more parameters which determine the transfer function modelling the acoustic transmission through said surface in a manner comparable to the previous parameter (one coefficient or coefficients for each frequency band, whereby, for the sake of clarity, the name of the field can be transcoeffSound; or parameters determining the transfer function).

SFInt MaterialIDSound

The field transfers an identifier which identifies a certain standard material in the database, the use of which was described above. If the surface described by this field is not of a standard material, then the parameter value transferred in this field can be for instance −1, or another agreed value.

The fields have been described above as potential additions to the known Material node. An alternative embodiment is to define a new node which we may call the AcousticMaterial node for the sake of example, and use the above-described fields or some similar and functionally equal fields as parts of the AcousticMaterial node. Such an embodiment would leave the known Material node to the exclusive use of graphical purposes.

The parameters mentioned above are always related to a certain surface. Because regarding the acoustic modelling of a space it is also advantageous to give certain parameters regarding the whole space it is possible to add an AcousticScene node to the known BIFS part, whereby the AcousticScene node is in the form of a parameter list and can contain fields to transfer for instance the following parameters:

MFAudioNode

The field is a table, whose contents tell which other nodes are affected by the definitions given in the AcousticScene node.

MFFloat Reverbtime

The field transfers a parameter or a set of parameters in order to indicate the reverberation time.

SFBool Useairabs

A field of the yes/no type which tells whether the attenuation caused by air shall be used or not in the modelling of the virtual acoustic environment.

SFBool Usematerial

A field of the yes/no type which tells whether the characteristics of the surfaces given in the BIFS part shall be used or not in the modelling of the virtual acoustic environment.

The field MFFloat reverbtime indicating the reverberation time can be defined for instance in the following way: If only one value is given in this field it represents the reverberation time used at all frequencies. If there are 2n values, then the consecutive values (the 1st and the 2nd value, the 3rd and the 4th value, and so on) form a pair, where the first value indicates the frequency band and the second value indicates the reverberation time at said frequency band.

From the MPEG-4 standard drafts we know a ListeningPoint node which represents sound processing in general and which represents the position of the listener in the space to be modelled. When the invention is applied to this node we can add the following fields:

SFInt Spatialize ID

The parameter given in this field indicates the identifier, with which we identify a function connected to the listening point concerning a specific application or user, such as the HRTF model.

SFInt Dirsoundrender

The value transferred in this field indicates which level of sound processing is applied for that sound which comes directly from the sound source to the listening point without any reflections. As an example we can conceive three possible levels, whereby a so called amplitude panning technique is applied on the lowest level, the ITD delays are further observed on the middle level, and on the highest level the most complex calculation (for instance HRTF models) is applied on the highest level.

SFInt Reflsoundrender

This field transfers a parameter representing a level choice corresponding to that of the above mentioned field, but concerning the sound coming via reflections.

Scaling is still one feature which can be taken into account when the virtual acoustic environment transferred in a data stream according to the MPEG-4 or the VRML standards or in other connections in a way according to the invention. All receiving devices can not necessarily utilise the total virtual acoustic environment generated by the transmitting device, because it may contain so many defined surfaces that the receiving device is not able to form the same number of filters or that the model processing in the receiving device will be too heavy regarding the calculation. In order to take this into account the parameters representing the surfaces can be arranged so that the most significant surfaces regarding the acoustics can be separated by the receiving device (the surfaces are for instance defined in a list where the surfaces are in an order corresponding to the acoustic significance), whereby a receiving device with limited capacity can process as many surfaces in the order of significance as it is able to.

The designations of the fields and parameters presented above are of course only exemplary, and they are not intended to be limiting regarding the invention.

Figure 6:
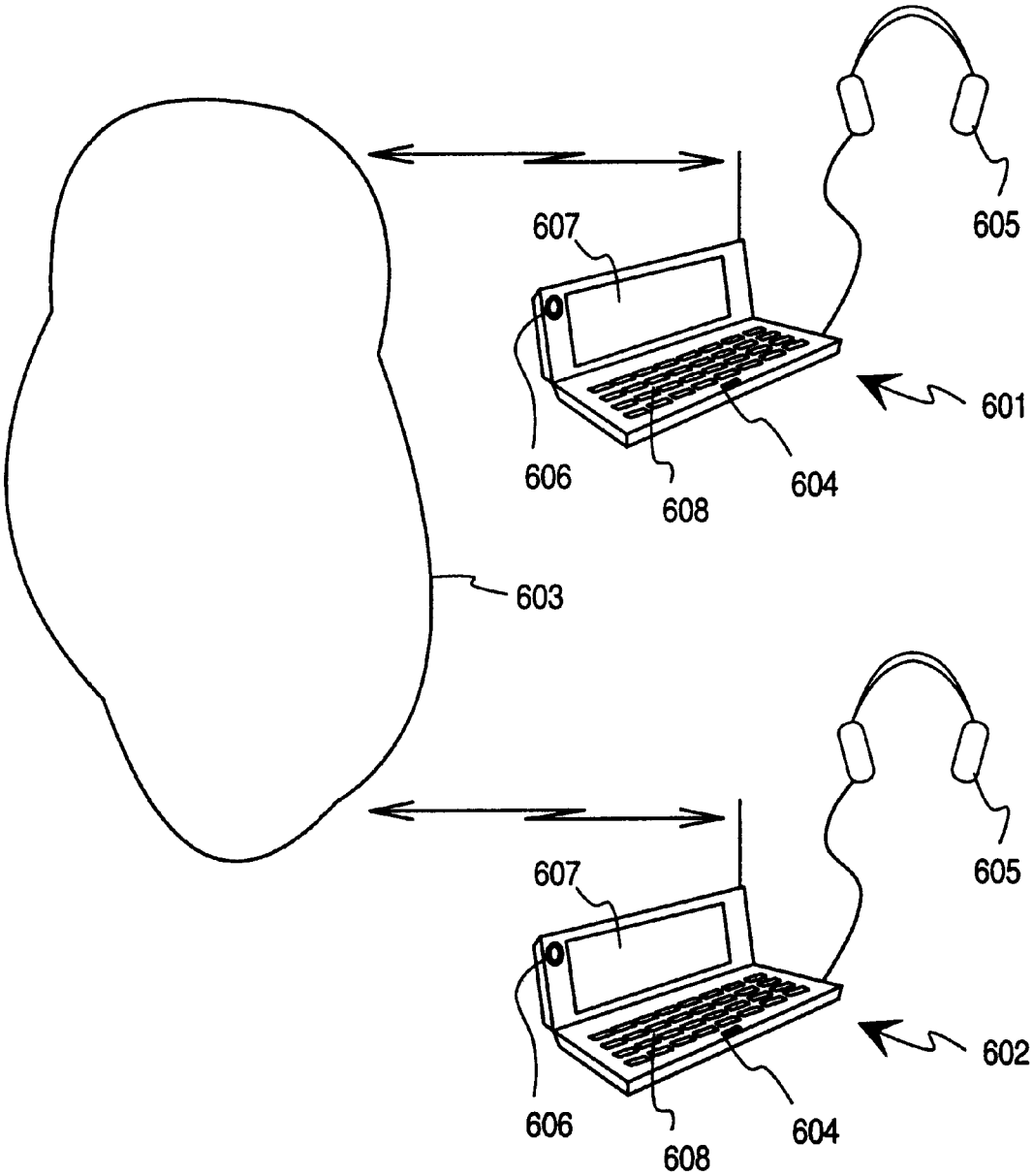
FIG. 6 shows another system for applying the invention.

To conclude with we will describe the application of the invention to a telephone connection, or more exactly to a video telephone connection over a public telecommunication network. Reference is made to FIG. 6, where there is a transmitting telephone device 601, a receiving telephone device 602 and a communication connection between them through a public telecommunication network 603. For the sake of example we will assume that both telephone devices are equipped for videophone use, meaning that they comprise a microphone 604, a sound reproduction system 605, a video camera 606 and a display 607. Additionally both telephone devices comprise a keyboard 608 for inputting commands and messages. The sound reproduction system may be a loudspeaker, a set of loudspeakers, earphones (as in FIG. 6) or a combination of these. The terms "transmitting telephone device" and "receiving telephone device" refer to the following simplified description of audiovisual transmission in one direction; a typical video telephone connection is naturally bidirectional. The public telecommunication network 603 may be a digital cellular network, a public switched telephone network, an Integrated Services Digital Network (ISDN), the Internet, a Local Area Network (LAN), a Wide Area Network (WAN) or some combination of these.

The purpose of applying the invention to the system of FIG. 6 is to give the user of the receiving telephone device 602 an audiovisual impression of the user of the transmitting telephone device 601 so that this audiovisual impression is as close to natural as possible, or as close to some fictitious target impression as possible. Applying the invention means that the transmitting telephone device 601 composes a model of the acoustic environment in which it is currently located, or in which the user of the transmitting telephone device wants to pretend to be. Said model consists of a number of reflecting surfaces which are modelled as parametrisized transfer functions. In composing the model the transmitting telephone device may use its own microphone and sound reproduction system by emitting a number of test signals and measuring the response of the current operating environment to the them. During the setup of the communication connection the transmitting telephone device transmits to the receiving telephone device the parameters that describe the composed model. As a response to receiving these parameters the receiving telephone device constructs a filter bank consisting of filters with the respective parametrisized transfer functions. Thereafter all audio signals coming from the transmitting telephone device are directed through the constructed filter bank before reproducing the corresponding acoustic signals in the sound reproduction system of the receiving telephone device, thus producing the audio part of the required audio-visual impression.

In composing the model of the acoustic environment some basic assumptions may be made. A user taking part in a person-to-person video telephone connection usually has a distance of some 40–80 cm between his face and the display. Thus, in the virtual acoustic environment tended to describe the users speaking face to face, a natural distance between the sound source and the listening point is between 80 and 160 cm. It is also possible to make some basic assumptions of the size of the room where the user is located with his video telephone device so that the reflections from the walls of the rooms can be accounted for. Naturally it is also possible to program manually the parameters of the desired acoustic environment to the transmitting and/or receiving telephone devices.

What is claimed is:

1. A method for processing a virtual acoustic environment that comprises surfaces, using a transmitting device, a receiving device, and a number of filters, comprising the steps of:

generating, in the transmitting device, a certain virtual acoustic environment with surfaces which are represented by filters having an effect on an acoustic signal, which effect depends on certain parameters that relate to a transfer function of each filter, so that each of said filters is associated with one of the surfaces of the virtual acoustic environment for describing the effect of such surface in the virtual acoustic environment with its associated filter, transferring from the transmitting device to the receiving device information about said certain parameters relating to the filters, and creating, in order to reconstruct the virtual acoustic environment, a filter bank in the receiving device comprising filters which have an effect on the acoustic signal depending on the parameters relating to each filter and generating the parameters relating to each filter on the basis of the information transferred from the transmitting device.

2. A method according to claim 1, where said parameters relating to the transfer function of each filter are coefficients representing the acoustic characteristics of the surface to which the filter in associated, said acoustic characteristics being chosen to be at least one of the following: reflection, absorption, transmission.

3. A method according to claim 1, where the step of transferring information from the transmitting device to the receiving device corresponds to the transmitting device transferring to the receiving device information about the parameters relating to each filter as a part of a data stream according to the MPEG-4 standard.

4. A method according to claim 1, wherein said parameters relating to the transfer function of each filter are coefficients of the Z-transform of the transfer function presented as the ratio $$H(z) = \frac{Y(z)}{X(z)} = \frac{\sum_{k=0}^{M} b_k z^{-k}}{1 + \sum_{k=1}^{N} a_k z^{-k}}.$$

5. A method for processing a virtual acoustic environment that comprises surfaces, comprising the steps of:

establishing a number of filters, each filter realizing a certain transfer function parametrisized with a predetermined set of parameters, and associating each of said filters with one of the surfaces of the virtual acoustic environment for describing the effect of such surface in the virtual acoustic environment with its corresponding associated filter, where said parameters relating to the transfer function of each filter are coefficients of the Z-transform of the transfer function presented as the ratio $$H(z) = \frac{Y(z)}{X(z)} = \frac{\sum_{k=0}^{M} b_k z^{-k}}{1 + \sum_{k=1}^{N} a_k z^{-k}}.$$

6. A method according to claim 5, wherein said parameters relating to the transfer function of each filter are coefficients representing the acoustic characteristics of the surface to which the filter is associated, said acoustic characteristics being chosen to be at least one of the following: reflection, absorption, transmission.

7. A method according to claim 5, further comprising the step of using a transmitting device for transferring information, about said set of parameters relating to the filters, to a receiving device, and wherein said step of transferring information corresponds to the transmitting device transferring to the receiving device information about the parameters relating to each filter as a part of a data stream according to the MPEG-4 standard.

8. A system for processing a virtual acoustic environment that comprises surfaces, said system comprising:

means for creating a filter bank of parametrisized filters for modelling the surfaces contained in the virtual acoustic environment;

a transmitting device;

a receiving device; and means for realising electrical data transmission between the transmitting device and the receiving devices; and wherein said means for creating a filter bank of parametrisized filters are located in said receiving device, and said receiving device is arranged to receive information about said parameters relating to the filters from said transmitting device.

9. A system according to claim 8, further comprising multiplexing means in the transmitting device for attaching parameters, which represent the characteristics of the parametrisized filters, to a data stream according to the MPEG-4 standard, and demultiplexing means in the receiving device for finding out the parameters, which represent the characteristics of the parametrisized filters, from the data stream according to the MPEG-4 standard.

10. A system according to claim 8, wherein said parameters relating to the filters are coefficients representing the acoustic characteristics of the surface to which the filter is associated, said acoustic characteristics being chosen to be at least one of the following: reflection, absorption, transmission.

11. A system according to claim 8, wherein said parameters relating to the filters are coefficients representing the acoustic characteristics of the surface to which the filter is associated, and relate to a transfer function of each filter as coefficients of the Z-transform of the transfer function presented as the ratio $$H(z) = \frac{Y(z)}{X(z)} = \frac{\sum_{k=0}^{M} b_k z^{-k}}{1 + \sum_{k=1}^{N} a_k z^{-k}}.$$

* * * * *